US005365813A

United States Patent [19]

Greene

[11] Patent Number: 5,365,813

[45] Date of Patent: Nov. 22, 1994

[54] SYSTEM FOR MAKING PICTURE FRAMES

[75] Inventor: Thomas F. Greene, Amesbury, Mass.

[73] Assignee: Production Plus, Inc., Amesbury, Mass.

[21] Appl. No.: 957,655

[22] Filed: Oct. 7, 1992

[51] Int. Cl.[5] ..... B26F 1/12

[52] U.S. Cl. ..... 83/35; 83/39; 83/406; 83/581

[58] Field of Search ..... 83/39, 405, 406, 581, 83/682, 683, 693, 917, 54, 35

[56] References Cited

U.S. PATENT DOCUMENTS

| | | | |
|---|---|---|---|
| 3,097,684 | 7/1963 | Tarte | 83/581 X |
| 3,299,759 | 1/1967 | Johnson et al. | 83/581 |
| 3,786,710 | 1/1974 | Backlin | 83/581 X |
| 3,938,413 | 2/1976 | Goettel et al. | 83/581 X |
| 4,328,725 | 3/1982 | Gschwend | 83/39 X |
| 4,731,047 | 3/1988 | Lobb | 83/406 X |

FOREIGN PATENT DOCUMENTS

| | | | |
|---|---|---|---|
| 2710886 | 9/1978 | Germany | 83/581 |

*Primary Examiner*—Eugenia Jones
*Attorney, Agent, or Firm*—Samuels, Gauthier & Stevens

[57] ABSTRACT

A system for forming picture frames which comprises first and second punching stations to form miters and notches in the picture frames. The punching stations are aligned along the same axis and the picture frame is fed linearly through the punches. Sets of drive rollers are controlled to move the picture frame through the punching stations in stepped sequence to form finished picture frames.

6 Claims, 9 Drawing Sheets

SYSTEM FOR MAKING PICTURE FRAMES

BACKGROUND AND BRIEF SUMMARY OF THE INVENTION

The invention relates to the manufacture of picture frames. The term picture frames as used in the industry and herein refers to an extruded member, almost always plastic, which can assume several geometric configurations. The picture frame is mitered at either end and notched between the mitered ends. The extruded member is folded at the notches and joined at the mitered ends when assembled, such as with backing, glass and/or a photograph or poster or the like. For a rectangular frame, there would be two mitered ends and three intermediate notches spaced such that the picture frame when folded folds on 90° angles.

Presently, when mitering and notching the picture frames, the size and shape (square, rectangular, etc.) of the picture frame is determined. The picture frame as extruded from an extrusion machine is cut to a length (size) slightly greater than will be required to form the picture frame. The present systems typically comprises several punch stations, i.e. two end mitering stations and two or more intermediate notching stations. For a rectangular frame, there would be three notching stations. Prior to a production run for a rectangular frame, the five stations are adjusted to ensure the proper spacing and thereby the proper dimensioning for the miters and notches. The picture frame is usually hand fed into the system. That is, a machine operator will insert the picture frame into the dies and then the two punches at either end which form the left and right hand miters and the three intermediate punches which form the notches will be actuated simultaneously. Subsequently, the notched and mitered picture frame is removed and a new picture frame is hand fed laterally into the machine.

Therefore, a major drawback of the present systems is the need for a separate punch for each notching and mitering station and the requirement of repositioning the punches each time the size and shape of a picture frame changes.

Also, in the prior art, the standard picture frame is snapped in place on the dies with the back piece vertical. However, picture frames of unique styles, say for example a frame with a 270° circular configuration (end view), cannot be conventionally punched because the picture frame cannot be positioned on the dies. In the present invention the picture frame is fed linearly into the system, not laterally, and therefore the system can process any style picture frame.

The present invention is directed to a system which utilizes two stations for any size and shape of picture frame. One punch forms the right and left hand mitered ends and the other punch forms the intermediate notches. The present invention eliminates the requirement that the picture frame be laterally inserted or hand fed to the system. In the system of the invention, the picture frame is fed in line or linearly into the system. This allows the system to be placed in line with the extrusion machine that extrudes the picture frame. As the picture frame is extruded, it is fed directly into the system.

The system eliminates the necessity of a single punch for each mitering and notching stations and the requirement of physically repositioning the punches each time a picture frame of a different size is made.

A further advantage of the system is that smaller picture frames, such as would form a 3×5 inch picture frame, can be made. In the prior art system, the punches for forming the miters and the notches simply could not be physically placed close enough together to form the notches in the picture frame. With the present invention, the picture frame can be moved forwardly or rearwardly and there are only two punches involved.

Broadly the invention comprises a system for the formation of a finished picture frame(s) comprising at least first and second punching stations to miter and notch the picture frame, means to drive the picture frame through the stations and means to control in stepped sequence the movement of the picture frame through the stations. The picture frame moves linearly through the system with stops at each station and the punches at the stations effect the mitering and notching of the picture frame.

DESCRIPTION OF THE PREFERRED EMBODIMENT

The System

Figure 1:
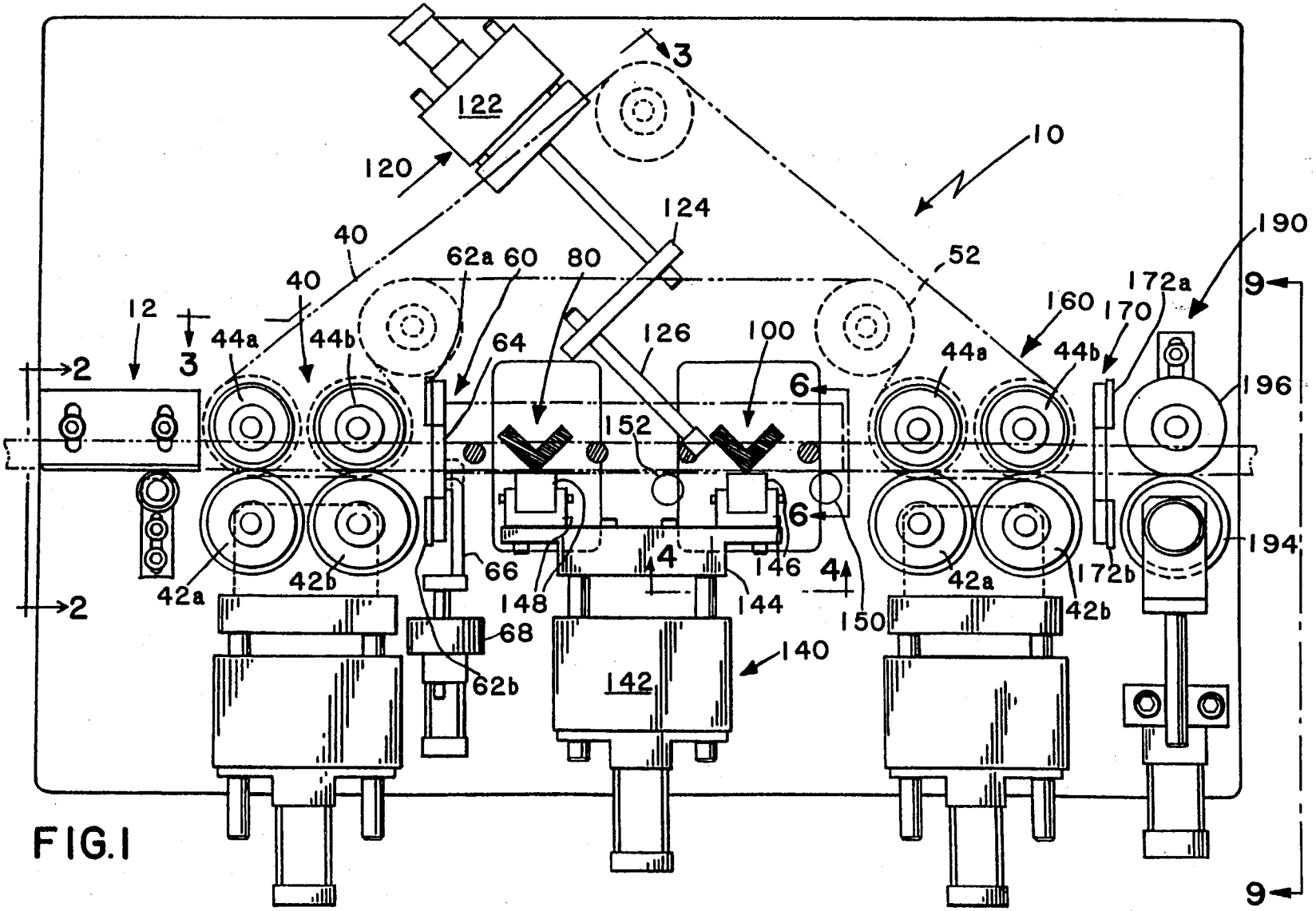
FIG. 1 is a plan, partly sectional view of a system embodying the invention.

Referring to FIG. 1, the system is shown generally at and comprises a guide station 12, a first drive assembly 40, a control stop assembly 60, a first punching station 80 and a second punching station 100. Associated with the second punching station 100 is a stripping assembly 120. Associated with both the punching stations is a blocking assembly 140. A second drive assembly 160 is positioned downstream of the second punching station 100. Exit sensors 170 are interposed between the second drive assembly 160 and an ejection station 190.

Feed Station

Figure 2:
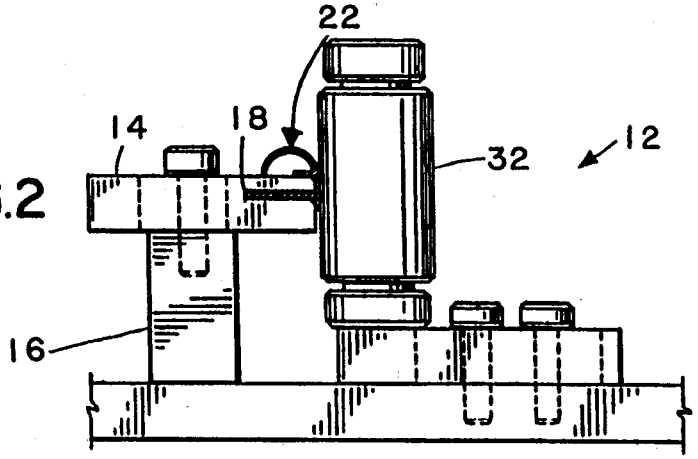
FIG. 2 is an end view of FIG. 1 taken along lines 2—2.
Figure 4:
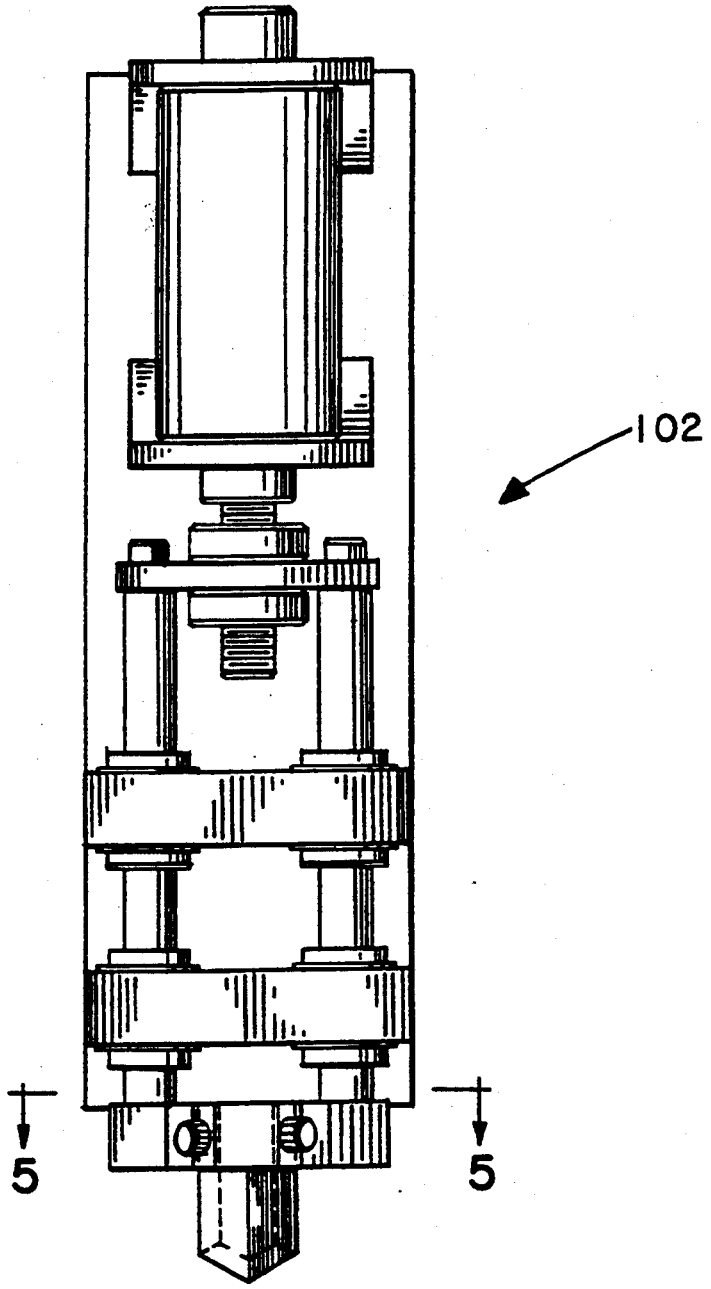
FIG. 4 is a view of FIG. 1 taken along lines 4—4.
Figure 5:
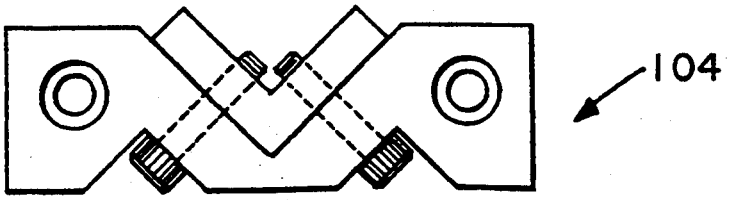
FIG. 5 is a view of FIG. 1 taken along lines 5—5.

Referring to FIG. 2, the feed station 12 is shown in greater detail and comprises a guide roller 14 rotatably pinned to a support 16. The guide roller is characterized by a slot 18. Received in the slot 18 is a picture frame 22.

The picture frame 22 comprises a back 24, top convex surface 26, an upper lip 28 and a lower lip 30. The lip 30 is received in the slot 18.

An adjustable nip roller 32 engages the back 24 of the picture frame 22.

Drive Assembly

Figure 3:
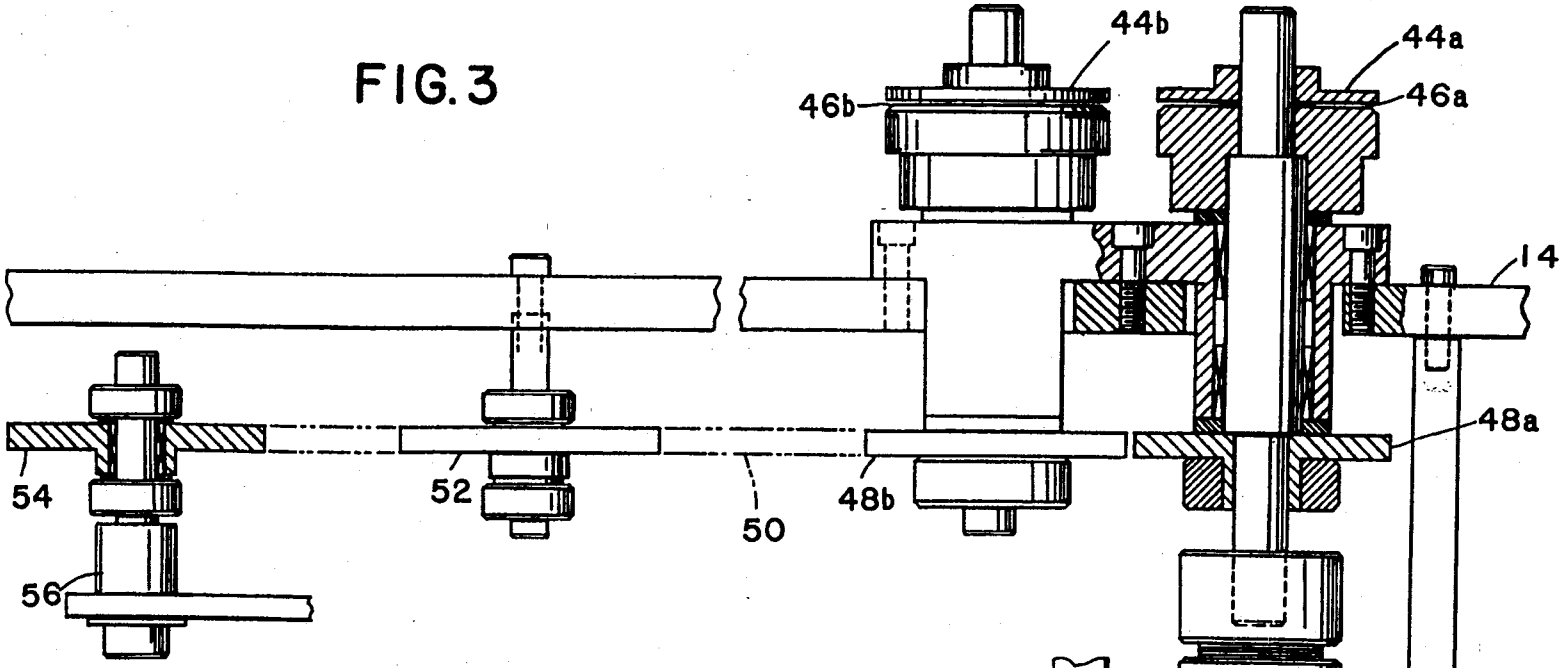
FIG. 3 is a view of FIG. 1 taken along lines 3—3.

Referring to FIGS. 1 and 3, the first drive assembly 40 is shown in greater detail and comprises a pair of nip rollers 42*a* and 42*b* which engage drive rollers 44*a* and 44*b*. The nip rollers 42*a* and 42*b* engage the back 24 of the picture frame 22. The drive rollers are characterized by slots 46*a* and 46*b* in which slots is received the lip 30 of the picture frame 22. The drive rollers are characterized by drive wheels 48*a* and 48*b* which are driven by a belt 50. A tensioning wheel 52 is shown together with the drive wheel 54 of a servomotor 56.

The second drive assembly 160 with its associated tensioning wheel 52 is identical to the first drive assembly 40.

Control Stop Assembly

Referring to FIG. 1, the assembly 60 comprises two fiberoptic sensors 62*a* and 62*b*. The sensors are mounted on a plate 64 which is above the path through which the picture frame travels. Responsive to the detection of the presence of a picture frame by the sensors 62*a* and 62*b* is a blocking arm 66 which arm is secured to a pneumatic cylinder 68. The arm is adapted to reciprocate between a blocking position, shown in dotted lines, in which it physically prevents inadvertent movement of the picture frame and a retracted position, shown in solid lines, where it is withdrawn from the path of travel of the picture frame.

Punching Stations

Referring to FIGS. 4, 5, 6 and 7, the punching stations 80 and 100 are shown in greater detail. The punching stations per se are basically standard punch/die sets being configured to provide the proper angle for the notch and miters. The punch at the station 80, in the preferred embodiment, is positioned to notch the frame and the punch station 100 is positioned to miter the picture frame. The station 100 includes a punch 102 and a die 104. The punch/die at the station 80 are identical.

Figure 6:
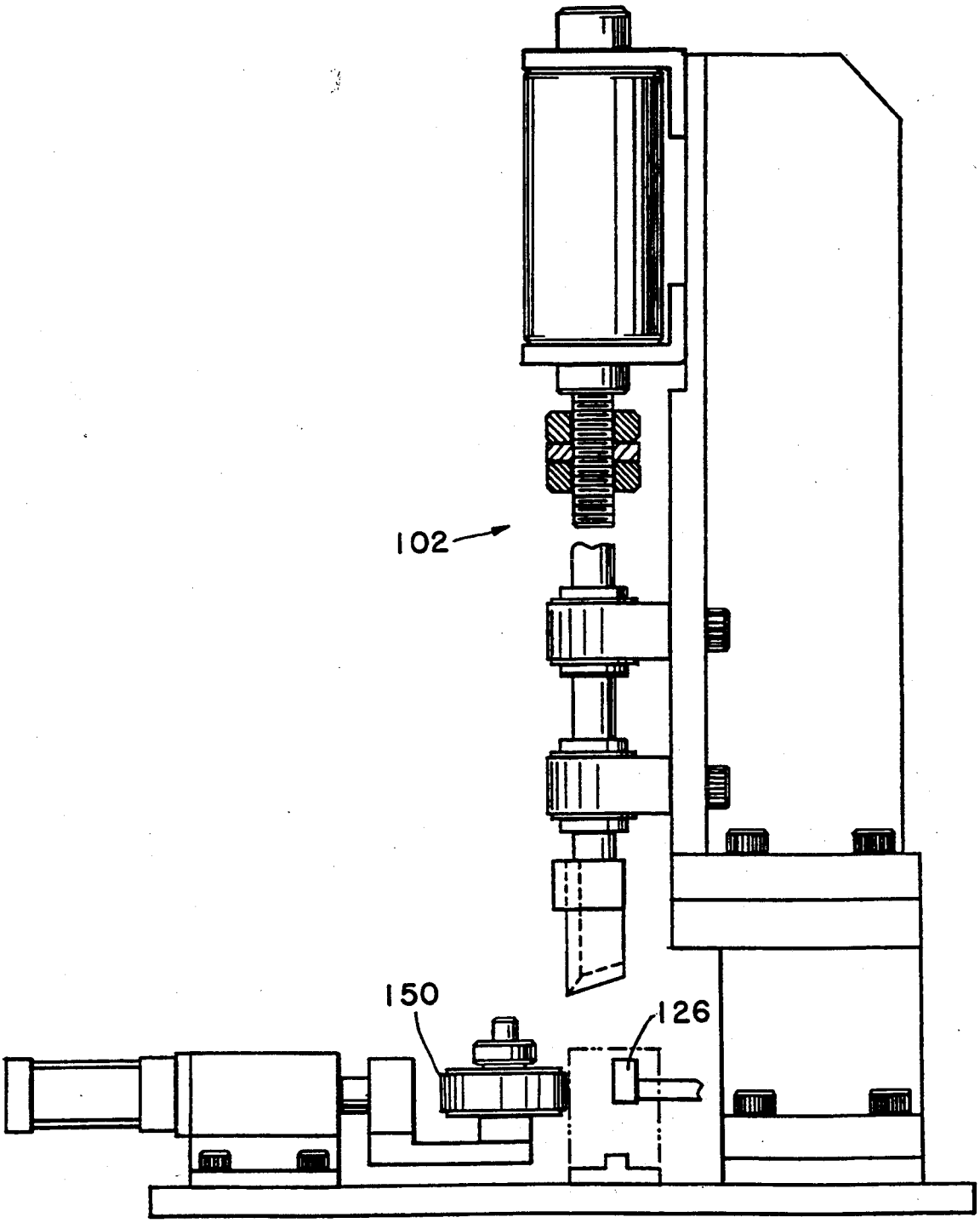
FIG. 6 is a view of FIG. 1 taken along lines 6—6.
Figure 7:
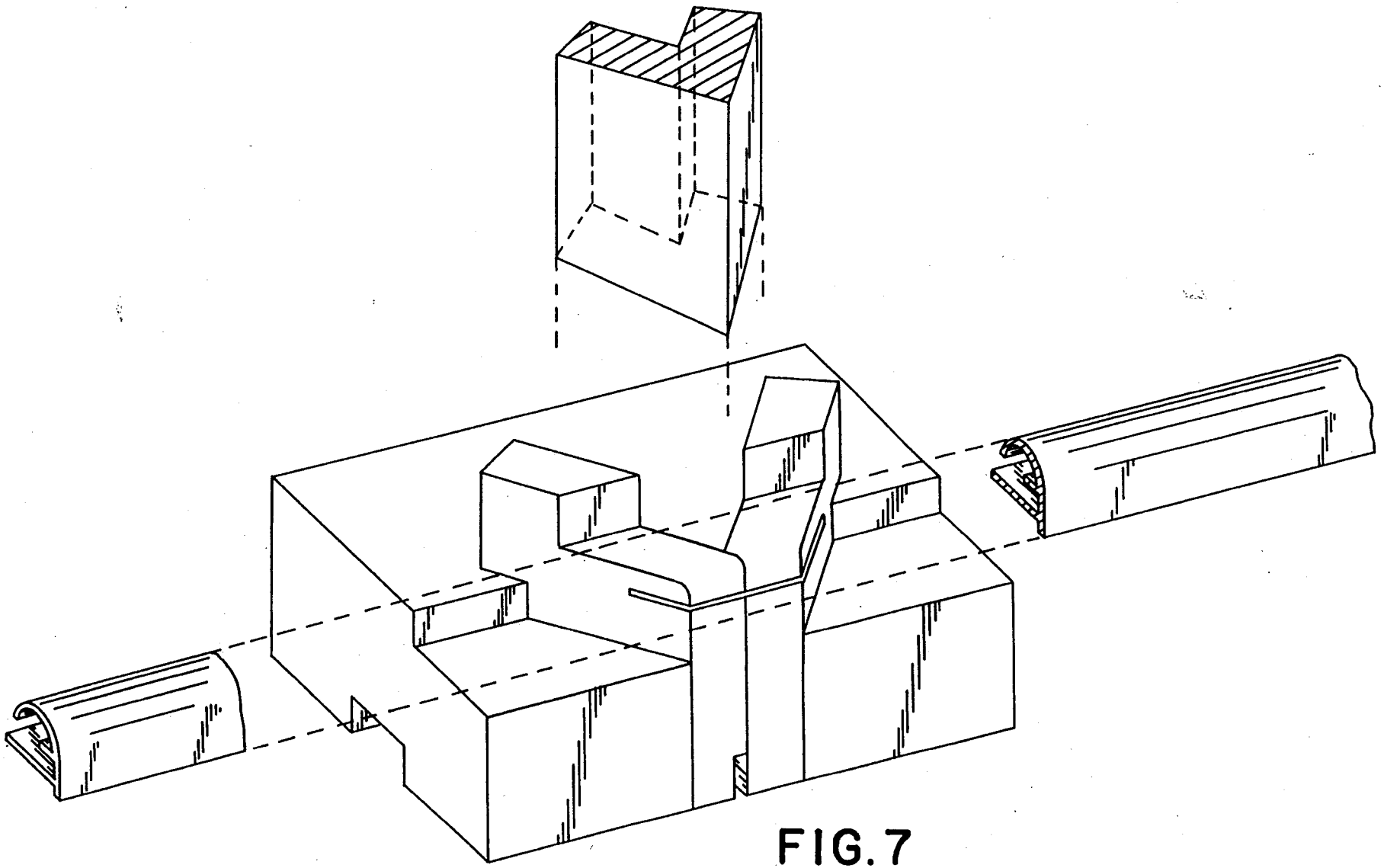
FIG. 7 is a perspective view of a punch/die assembly of the system of FIG. 1.

As shown in FIGS. 1 and 6, a stripping assembly 120 comprises a pneumatic cylinder 122 which carries a plate 124 which in turn carries a stripping piston 126. As shown, the stripping piston 126 lies just upstream of the die 104 and is adapted for reciprocal movement between an extended position, shown in dotted lines, where it extends into the path through which the picture frame travels and a retracted position, shown in solid lines, where it is clear of the path through which the picture frame travels.

Blocking Assembly

Figure 8:
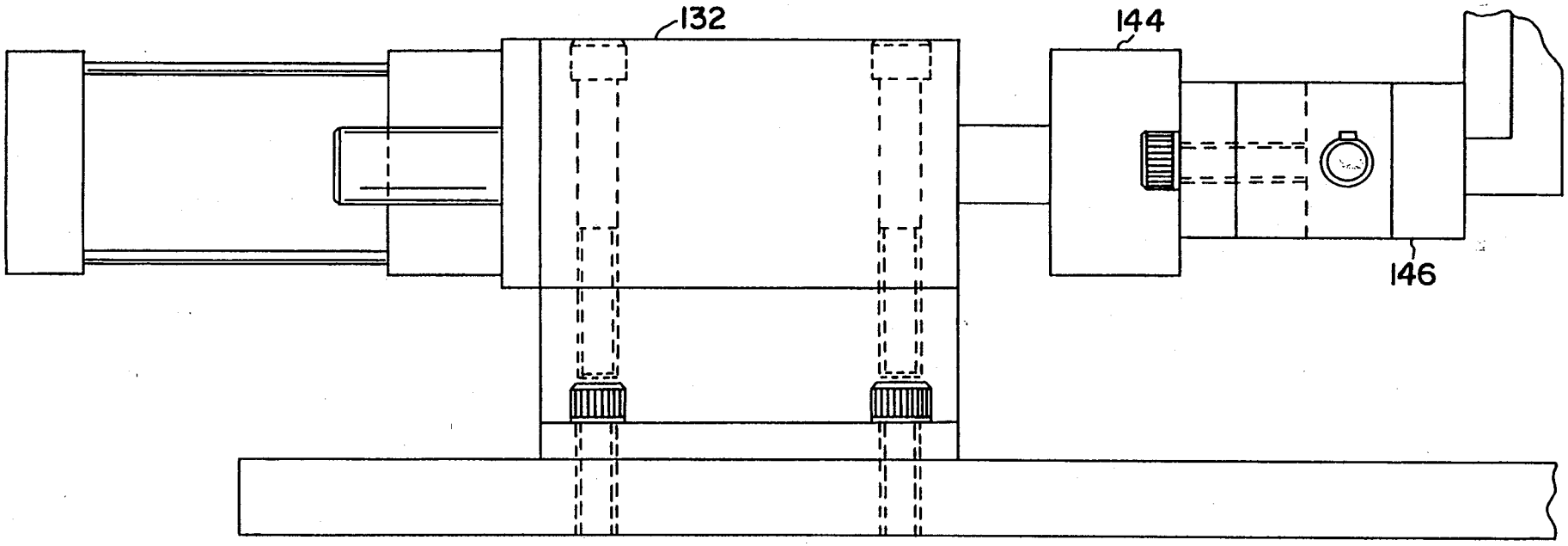
FIG. 8 is a side view of a blocking assembly.

The blocking assembly 140 is shown most clearly in FIGS. 1 and 8 and comprises a pneumatic cylinder 142 which carries a plate 144 which plate carries first and second pressure blocks 146 and 148. The pressure blocks are in register with the dies 104 and during the punching operations engage the back 24 of the picture frame 22.

Referring to FIGS. 1 and 6, guide rollers 150 and 152 maintain the position of the picture frame during processing.

Ejection Station

Downstream of the second drive assembly is a plate 170 on which is mounted a pair of fiberoptic sensors 172*a* and 172*b* which sense the presence or absence of a picture frame.

Figure 9:
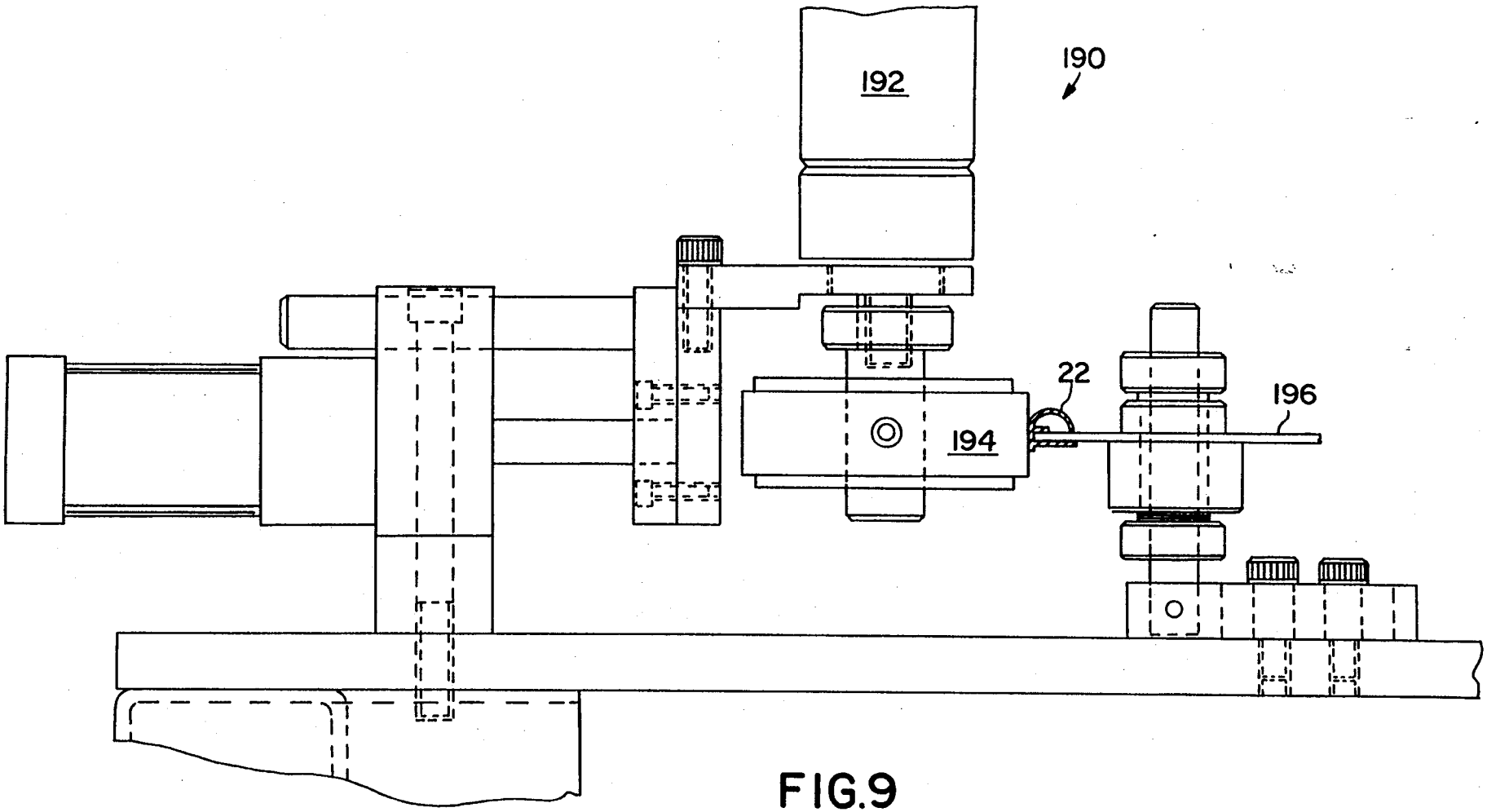
FIG. 9 is a view of FIG. 1 taken along lines 9—9.

The ejection station 190, shown in FIGS. 1 and 9, comprises an air motor 192 which drives a driver roller 194. The roller 194 cooperates with a nip roller 196.

Operation of the Invention

In the operation of the invention, a series of steps are effected in timed sequence on a picture frame. The steps include moving the picture frame in a pre-determined stepped sequence along a linear path. The picture frame is moved to stations where mitering and notching are performed. Additionally, sensors determine the presence or absence of the picture frame. Sensing the presence of the picture frame precisely locates the picture frame in the system. Sensing the absence of the picture frame initiates the discharge of the trailing piece of the picture frame and the ejection of the last made picture frame from the system.

Figure 10:
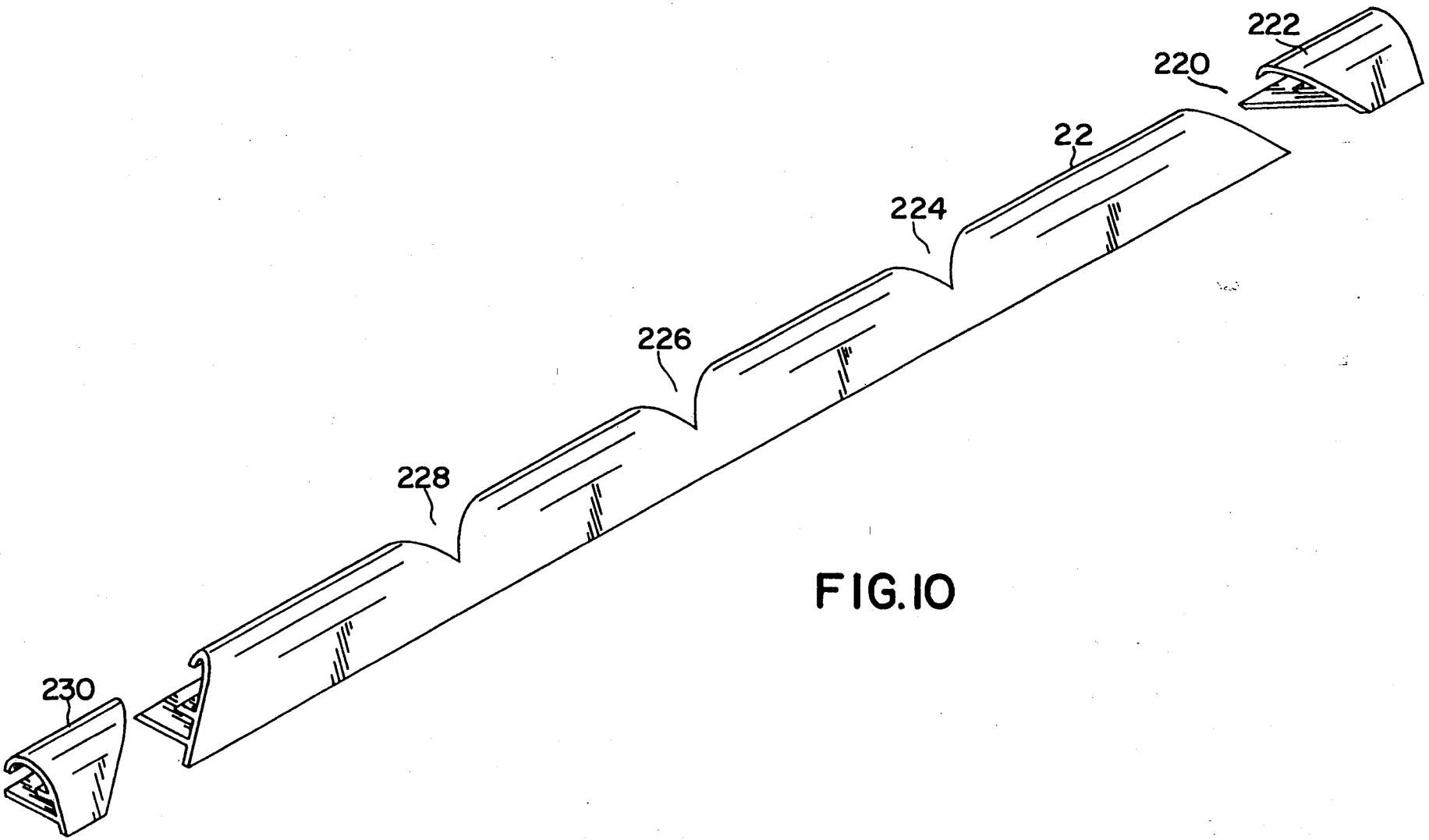
FIG. 10 is a perspective view of a picture frame.

Referring to FIG. 10, a picture frame is shown with the locations where the first miter, the next successive three notches and the last miter are marked in dotted lines. Upstream of the first miter is a leading piece of picture frame and downstream of the last miter is a trailing piece of picture frame.

Figure 11:
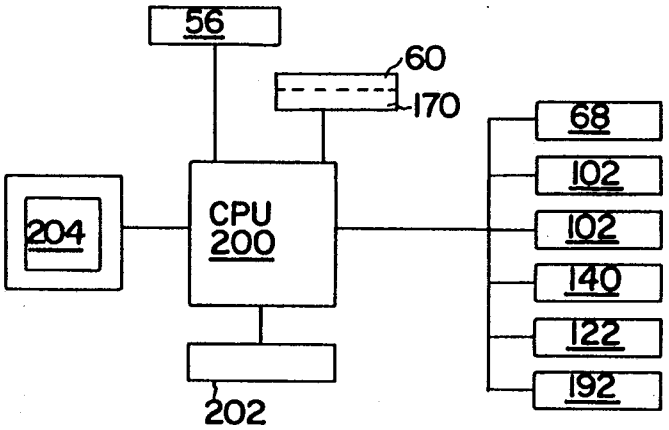
FIG. 11 is a functional block diagram of the system controls.
Figure 12E:
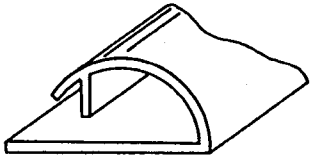
FIGS. 12*a* through 12*e* are end views of various picture frames.
Figure 12D:
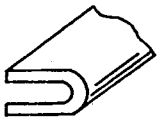
Figure 12C:
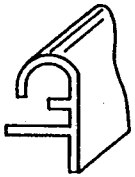
Figure 12B:
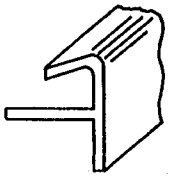
Figure 12A:
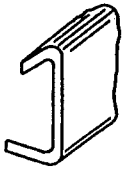
Figure 13E:
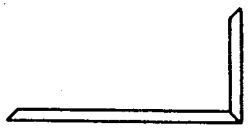
FIGS. 13*a* through 13*e* are schematic illustrations of assembled picture frames.
Figure 13D:
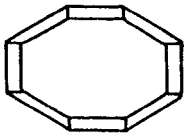
Figure 13C:
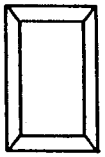
Figure 13B:
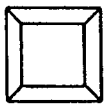
Figure 13A:
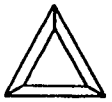

Referring to FIG. 11, a functional block diagram of the system is shown and comprises a controller 200 to effect the sequence of steps, such as an Alan Bradley SLC 150 programmable controller, a keyboard 202 and a monitor 204, the servomotor 56 which drives the drive rollers of the drive stations, the fiberoptic sensors 62 and 172, the cylinder 68, the punches 102, the blocking assembly 140, the cylinder 122 and the air motor 192.

The control electronics and/or pneumatics for effecting these various steps are not shown in detail—these features being well known and within the skill of the art. Also, the programming of the controller to effect the sequence of steps is well within the skill of the art and need not be described in detail.

The operation will be described in reference to the mitering and notching of a specific configuration of a picture frame. Other picture frame configurations, FIG. 12, and picture frame shapes, such as shown in FIG. 13, can also be mitered and notched with the present invention with the dies and punches at the notching and mitering stations designed accordingly and the computer reprogrammed to change the distance the picture frame is driven.

When commencing operation the following sequence of steps is typical for forming a 20"×16" picture frame. The picture frame fed to the system can be any length. Preferably as a picture frame is extruded it is fed directly to the system.

1. The system 10 is actuated and a picture frame 22 is inserted into the entry guide 12 and through the first set of nip/drive rollers 42–44. The servomotor 56 drives the drive rollers 44 (of both entry and exit nips) until the picture frame is sensed by the entry fiberoptics 62. At this point, the servomotor stops and the blocking arm 66 simultaneously moves to prevent any inadvertent extension of the picture frame. The system knows the exact location of the leading edge of the picture frame 22. The blocking arm retracts.

2. The servomotor 56 is actuated and the leading edge of the picture frame 22 is moved to the station 100 with the leading edge extending slightly beyond the punch and die assembly.

3. The servomotor stops, the pressure blocks 146–148 engage the picture frame and the punch 102 at the station 100 drives into the picture frame to form the miter 220 and the leading piece 222 falls away.

4. The servomotor 56 is actuated and the picture frame 22 is driven such that its location at the station 80 is 20" from the mitered end.

5. The servomotor stops, the pressure blocks engage the picture frame, the punch 102 at the station 80 drives into the picture frame to form a notch 224.

6. The servomotor is actuated and the picture frame is driven until it is at the station 80 16" from the previous notch.

7. Step 5 is repeated to form the notch 226.

8. The servomotor is actuated and the picture frame is driven until it is at the station 80 20" from the previous notch.

9. Step 5 is repeated to form the notch 228.

10. The servomotor is actuated and the picture frame is driven until it is located at the station 100 where it is 16" from the previous notched location on the picture frame.

11. Step 3 is repeated. This step forms the trailing miter of finished picture frame, n, and the leading miter of the next finished picture frame, $n_1$, to be formed.

12. Steps 3 through 11 are repeated. When no picture frame is sensed by the entry fiberoptic sensors 62, subsequent to the last mitering step the stripping piston is actuated and the trailing piece 230 is ejected. The last mitering step forms the trailing miter on the last, $n_x$, finished picture frame.

13. The servomotor is actuated and the nip/drive rollers of the second drive assembly move the frame, $n_x$.

14. When the exit fiberoptic sensors 172 detect the absence of the picture frame, the ejection drive roller 194 is actuated to discharge the picture frame, $n_x$, from the system.

Although described with reference to a 16"×20" picture frame and the lineal projection of the picture frame through the machine, the controller can be programmed to miter and notch picture frames at any locations and the picture frame can be driven in both forward and reverse directions to accomplish the mitering and notching.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A method for the formation of a picture frame having planar and curvilinear surfaces which comprises:

moving the picture frame forwardly to a first punching station;

punching the picture frame through the surfaces to form a leading miter;

moving the picture frame rearwardly to a second punching station upstream from the first punching station;

punching a first notch in the picture frame;

repositioning the picture frame at the second punching station;

punching a second notch in the picture frame;

repositioning the picture frame at the first punching station; and punching a trailing miter in the picture frame to form a finished picture frame.

2. The method of claim 1 which comprises: sensing the presence of the picture frame prior to moving the picture frame forwardly to the first punching station; and precisely positioning the picture frame with reference to the first and second punching stations.

3. The method of claim 2 which comprises: moving the picture frame predetermined distances between said punching stations.

4. The method of claim 3 wherein the first and second punching stations lie on the same axis, and which comprises:

moving the picture frame through the punching stations in a lineal direction along the axis of alignment.

5. The method of claim 4 which comprises:

sensing the absence of the picture frame upstream of the first punching station after punching the second notch in the picture frame; and moving the picture frame to the first punching station to form the trailing miter.

6. The method of claim 5 which comprises:

moving the finished picture frame downstream from the first punching station after punching the trailing miter;

sensing the absence of the picture frame at a location downstream of the first punching station; and ejecting the finished picture frame.

* * * * *